US005735156A

United States Patent [19]

Yoshitomi et al.

[11] Patent Number: 5,735,156

[45] Date of Patent: Apr. 7, 1998

[54] METHOD AND APPARATUS FOR FORMING A NON-CIRCULAR PIPE

[75] Inventors: Yuji Yoshitomi, Ibaraki-ken; Shinji Tanaka, Ushiku; Shota Iwakura, Ibaraki-ken; Takeshi Araya, Hitachi; Takamitsu Nakazaki, Takahagi; Norio Yokoba; Toshimi Sato, both of Hitachi, all of Japan

[73] Assignee: Hitachi, Ltd., Tokyo, Japan

[21] Appl. No.: 862,296

[22] Filed: May 22, 1997

Related U.S. Application Data

[63] Continuation of Ser. No. 529,981, Sep. 19, 1995, abandoned.

[30] Foreign Application Priority Data

Sep. 20, 1994 [JP] Japan ..... 6-224763

[51] Int. Cl.[6] ..... B21D 26/02

[52] U.S. Cl. ..... 72/57; 72/58; 29/421.1

[58] Field of Search ..... 72/57, 58, 60; 29/421.1

[56] References Cited

U.S. PATENT DOCUMENTS 1,984,002 12/1934 Ward ..... 72/55
5,445,001 8/1995 Snavely ..... 72/55

OTHER PUBLICATIONS

Japanese Patent Unexamined Publication No. 55-77934 Date Jun. 1980.
Japanese Patent Uenxamined Publication No. 55-55819 Date Apr. 1980.

*Primary Examiner*—David Jones
*Attorney, Agent, or Firm*—Antonelli, Terry, Stout, & Kraus, LLP

[57] ABSTRACT

A method of forming a non-circular pipe having a different sectional shape in the longitudinal direction thereof by bending a raw pipe while applying pressure to the inside of the raw pipe, wherein the circumference of a section of the raw pipe is substantially equalized to the circumference of a section, corresponding to the section of the raw pipe, of the non-circular pipe after formed.

8 Claims, 9 Drawing Sheets

METHOD AND APPARATUS FOR FORMING A NON-CIRCULAR PIPE

This application is a continuation application of Ser. No. 08/529,981 filed Sep. 19, 1995, now abandoned.

BACKGROUND OF THE INVENTION

The present invention relates to a method and an apparatus for forming a non-circular pipe to be used as a fluid path member.

A pipe having a different sectional shape in the longitudinal direction is called a non-circular pipe.

Press forming methods are noted heretofore as methods of forming a non-circular pipe. In one of the methods, two parts which respectively correspond to ones obtained by dividing the non-circular pipe in the longitudinal direction are formed by cold- or hot-pressing a plate and thereafter are welded to each other.

In Japanese Patent Unexamined Publication No. 55-77934, a forming method is disclosed which includes thrusting upper and lower dies formed to exhibit an irregular sectional surface while a raw material pipe having a circular section is loaded with axial tensile force lower than a yield point and internal pressure, and raising up the internal pressure while holding the dies together in order to form a non-circular pipe.

In addition, in Japanese Patent Unexamined Publication No. 55-55819, a method of expanding a pipe to be worked by applying internal pressure, and at the same time, successively displacing split dies divided into several pieces so as to form the pipe.

With the method of integrating two press worked parts by welding like the above-mentioned conventional method, it is necessary to work a three-dimensionally curved beveling on joint portions of press worked parts, and a lot of hours are consumed for performing the working. In addition, since the press worked parts have poor dimensional accuracy, many hours are consumed for correctively deforming the beveling plane at the time of welding so as to locate the bevelling plane in alignment with a reference. Since thermal deformation is caused when two parts are but-welded, there exists a problem that the integrated non-circular pipe has poor dimensional accuracy.

On the other hand, with the method of thrusting dies against a raw material pipe having a circular section, and applying pressure to the inside of the raw material pipe to form a non-circular pipe, since a quantity of deformation is different at respective positions in the longitudinal direction of the non-circular pipe during a process of forming, a large tensile strain is applied not only in the circumferential direction but also in the axial direction, so that it is difficult to obtain high forming accuracy; particularly it is difficult to finish the wall thickness of the non-circular pipe at a high accuracy. In addition, since the internal pressure is increased while the non-circular pipe is held in the dies so as to determine a form in conformity with the contour of the dies, a very high intensity of internal pressure should be loaded. This leads to the problem that the forming apparatus must be large in size and a large amount of installation cost is required.

With the method of bending while expanding a pipe, since the bending operation and the expanding operation are simultaneously performed, local reduction of wall thickness is liable to occur, and it is difficult to finish the wall thickness after completion of the forming operation at a high accuracy.

When the bending split dies divided into several pieces are successively displaced to perform a forming operation, it is complicated to control the split dies.

Therefore, a gas turbine having parts formed by the foregoing methods used as flow passage parts has poor reliability due to poor forming accuracy of the flow path parts, and since part design is conducted with a thin wall portion as a reference, there exists a problem that the gas turbine is heavy and expensive.

SUMMARY OF THE INVENTION

An object of the present invention is to solve the above-mentioned problems of the prior art and provide a method for forming a non-circular pipe at a high dimensional accuracy with a small amount of working time, an inexpensive apparatus for forming a non-circular pipe; and a gas turbine having a non-circular pipe used therein having good reliability.

According to an aspect of the present invention, there is provided a method for forming a non-circular pipe having a different sectional shape in the longitudinal direction thereof by bending a raw pipe while applying pressure to the inside of the raw pipe, wherein the circumference of a section of the raw pipe is substantially equalized to the circumference of a section, corresponding to section of the raw pipe, of the non-circular pipe after formed.

According to another aspect of the present invention, there is provided a method for forming a non-circular pipe having a different sectional shape in the longitudinal direction thereof by bending a raw pipe while applying pressure to the inside of the raw pipe, wherein the circumference of a section of the raw pipe is substantially equalized to the circumference of a section, corresponding to the section of the raw pipe, of the non-circular pipe after formed, wherein the raw pipe is symmetrical with respect to an axial center thereof.

According to another aspect of the present invention, there is provided a method for forming a non-circular pipe having a different sectional shape in the longitudinal direction thereof by bending a raw pipe while applying pressure to the inside of the raw pipe, wherein said raw pipe is expanded so that the circumference of a section of the raw pipe is substantially equalized to the circumference of a section, corresponding to the section of the raw pipe, of the non-circular pipe after formed; and thereafter the raw pipe is bent to form the non-circular pipe; wherein the expansion and the bending of the raw pipe are performed by means of the same apparatus.

According to still another aspect of the present invention, there is provided a method for forming a non-circular pipe having a different sectional shape in the longitudinal direction thereof by bending a raw pipe while applying pressure to the inside of the raw pipe, wherein the raw pipe is expanded so that the circumference of a section of the raw pipe in the longitudinal direction thereof is substantially equalized to the circumference of a section, corresponding to the section of the raw pipe, of the non-circular pipe after formed, and the raw pipe is symmetrical with respect to an axial center thereof; and thereafter the raw pipe is bent to form the non-circular pipe; wherein the expansion and bending of the raw pipe are performed by means of the same apparatus.

According to still another aspect of the present invention, there is provided a method for forming from a raw pipe into a non-circular pipe having a different sectional shape in the longitudinal direction thereof, the method comprising a first step of applying a predetermined pressure to the inside of the raw pipe to prevent bending buckling of the raw pipe and a second step of applying a load to the raw pipe in a direction perpendicular to the longitudinal direction of the raw pipe to bend and shape the raw pipe into the non-circular pipe.

According to still another aspect of the present invention, there is provided a method for forming a raw pipe into a non-circular pipe having a different sectional shape in the longitudinal direction thereof, the method comprising a first step of applying pressure to the inside of the raw pipe to expand a portion around axial center of the raw pipe, a second step of applying a predetermined pressure to prevent buckling of the raw pipe due to bending and a third step of applying a load to the raw pipe in a direction perpendicular to the longitudinal direction of the raw pipe to bend and shape the raw pipe into the non-circular pipe.

According to still another aspect of the present invention, there is provided an apparatus for forming a non-circular pipe comprising means for applying pressure to the inside of a raw pipe; expansion dies for expanding a portion of the raw pipe an axial center thereof; means for supporting as well as for opening and closing the expansion dies; forming dies to bend and form the raw pipe to a non-circular pipe having a predetermined form; and means for applying a pressing load to the raw pipe by means of the forming dies.

According to another aspect of the present invention, there is provided a gas turbine part comprising a non-circular pipe usable for a gas turbine wherein one end surface of the non-circular pipe exhibits a circular shape, the other end surface exhibits a substantially rectangular shape, and a respective sectional shape between the one end surface and the other end surface continuously changes from a circular shape to a substantially rectangular shape, wherein the gas turbine part is formed by using any one of the aforementioned methods.

With the methods as mentioned above, since each section of the raw pipe does not cause a large tensile strain in the circumferential direction by substantially equalizing the circumference of each section perpendicular to the axial direction of the raw pipe to the circumference of each section of the corresponding non-circular pipe after formed, when the raw pipe is bent while applying pressure to the inside of the raw pipe, it is formed to the contour corresponding to the dies.

Further, because the raw pipe is made to be symmetrical with respect to an axial center thereof, two non-circular pipes having the same configuration, can be made at the same time.

When an expansion forming step of expanding the diameter of the raw pipe and a step of forming the expanded raw pipe to a predetermined configuration of the non-circular pipe are performed in the same apparatus, an error in placing the raw pipe in the forming apparatus can be obviated, and a formed product can be obtained at a high accuracy.

In addition, when a step of expanding the raw pipe and a step of forming the non-circular pipe to a predetermined configuration are performed in the same apparatus, internal pressure loading means can be used for both steps.

Further, when the expansion dies for the raw pipe are displaced in the divided state in the horizontal direction by the supporting and opening/closing means, a forming operation can be performed without an occurrence of interference of a loading mechanism usable in the preceding step with a loading mechanism to be used at the forming step for forming the non-circular pipe to a predetermined configuration.

DESCRIPTION OF THE PREFERRED EMBODIMENTS

A first embodiment of the present invention will be described below with reference to FIG. 1 to FIG. 7.

Figure 1:
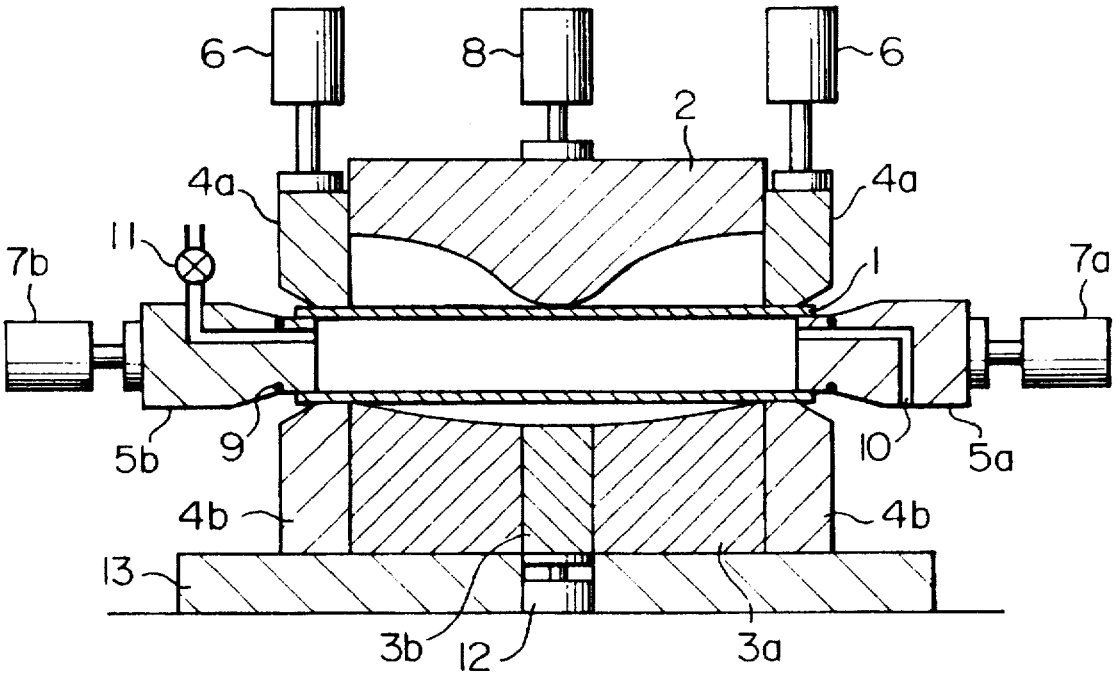
FIG. 1 is a sectional view of a forming apparatus for forming a non-circular pipe in accordance with a first embodiment of the present invention.

FIG. 1 is a sectional view of an apparatus for forming a non-circular pipe with a cylindrical pipe as a raw material. In FIG. 1, reference numeral 1 denotes a cylindrical raw pipe, reference numeral 2 denotes an upper die for forming an upper contour of the pipe, and reference numerals **3*a* and 3*b* denote a lower dies for forming a lower contour of the pipe. The central die 3*b* is used to remove the pipe after formed. Reference numerals 4*a* and 4*b* denote raw pipe holders for firmly holding the opposite ends of the raw pipe, reference numerals 5*a* and 5*b* denote seal cylinders for sealing the pipe when the inside of the pipe is pressurized, reference numeral 6 denotes a restricting hydraulic cylinder, reference numerals 7a and 7b denote hydraulic cylinders for thrusting the seal cylinders 4a and 4b against the pipe, reference numeral 8 denotes a hydraulic cylinder for pressing the upper die 2 to work the pipe, reference numeral 9 denotes a seal member for sealing the seal cylinder and the pipe, reference numeral 10 denotes a hydraulic pressure introducing hole through which hydraulic liquid is introduced into the pipe to press the pipe with the hydraulic liquid, reference numeral 11 denotes an air vent valve for venting air in the pipe, reference numeral 12 denotes a knock-out hydraulic cylinder for raising up the lower die 3b, and reference numeral 13** denotes a pedestal.

A procedure for forming a non-circular pipe using the forming apparatus shown in FIG. 1 will be described in the following. First, while the upper die 2 and the upper holders 4a are displaced in the upward direction, the cylindrical raw pipe 1 is placed on the lower dies 3a and 3b and the lower holders 4b. Thereafter, the upper holders 4a are lowered by actuating the holder restricting hydraulic cylinders 6 in order to firmly hold the cylindrical raw pipe 1. While the foregoing state is maintained, the seal cylinders 5a and 5b are displaced in the forward direction by actuating the hydraulic cylinders 7a and 7b in order to work the opposite ends of the cylindrical raw pipe 1 into flaring ends, and at the same time, the seal members 9 are thrusted against the pipe 1 so as to seal the inside of the pipe 1.

Further, liquid that is a pressure medium is supplied through the liquid pressure introducing hole 10 in the seal cylinder 5a by a pump (not shown) so that air in the pipe is expelled and the pipe is filled with the liquid. When it is confirmed that the pipe is filled with the liquid, the air vent valve 11 disposed on the seal cylinder 5b is closed, and the liquid is additionally supplied in the pipe by the pump (not shown) until the pipe is loaded with a predetermined internal pressure pl. It should be noted that when an air vent hole connected to the air vent valve 11 is located at an upper position on the seal cylinder 5b as far as possible, a quantity of air remaining in the pipe 1 can be reduced.

While the foregoing state is maintained, the upper die 2 is lowered by actuating the hydraulic cylinder 8 to impart a load W to the pipe 1, whereby the pipe 1 is bent to exhibit non-circular contour.

Figure 2:
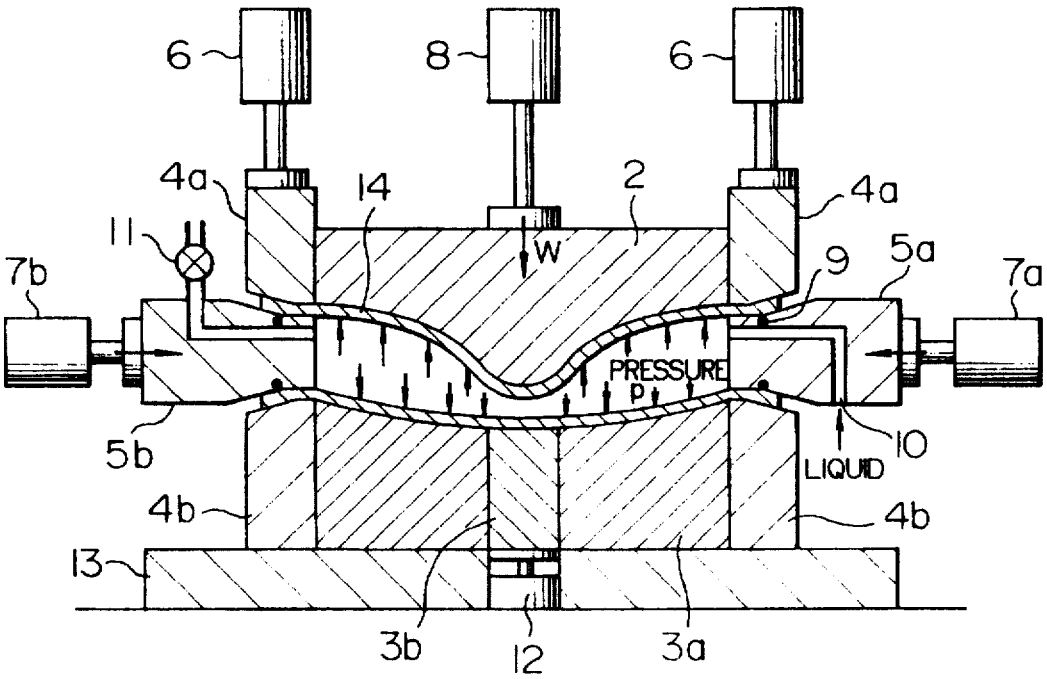
FIG. 2 is a sectional view of the forming apparatus shown in FIG. 1, explaining a process for forming a non-circular pipe.

Finally, the internal pressure in the pipe is elevated to a predetermined value p2, and the forming is completed in conformity with the upper and lower dies, as shown in FIG. 2.

The thus formed non-circular pipe is taken out in accordance with the following procedure. First, the internal pressure is reduced to be a level of zero. Next, the upper die 2 and the upper holders 4a are raised up by the hydraulic cylinders 6 and 8, and thereafter, the seal cylinders 5a and 5b are displaced in the rearward direction by the hydraulic cylinders 7a and 7b to release the formed product from the restricted state. Finally, a part 3b of the lower die 3a is raised up by the knock-out hydraulic cylinder 12 so that the formed non-circular pipe 14 is taken out of the lower dies 3a and 3b.

In this embodiment, the knock-out hydraulic cylinder 12 is exemplified a means for raising up a part of the lower die. However, provided that it is possible to raise up the die, a mechanical member such as spring, lever or the like or a pneumatic cylinder of course can be used.

Figure 3:
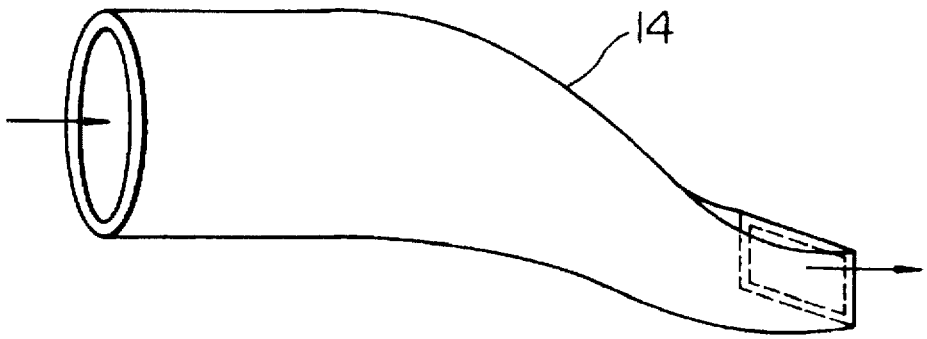
FIG. 3 is a perspective view of the non-circular pipe formed in accordance with the first embodiment of the present invention.

The non-circular pipe shown in FIG. 3 is a piping member which is usable as a flow passage for gas or the like. The gas inflow side exhibits a circular section and the gas outflow side exhibits a rectangular section. A sectional shape of the intermediate part between the gas inflow side and the gas outflow side continuously varies so that the direction of flowing of gas on the gas inflow side is deviated from the direction of flowing of gas on the gas outflow side.

Figure 4:
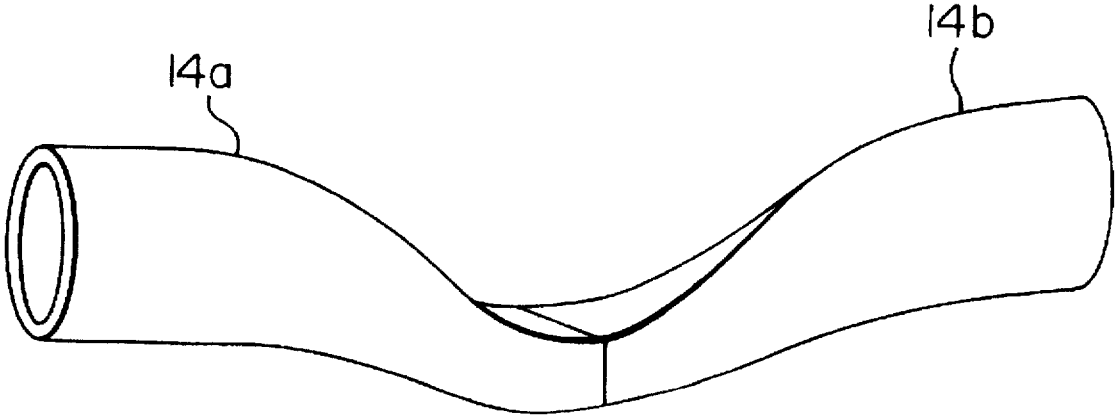
FIG. 4 is a perspective view of a formed product having two non-circular pipes shown in FIG. 3 connected to each other.
Figure 5:
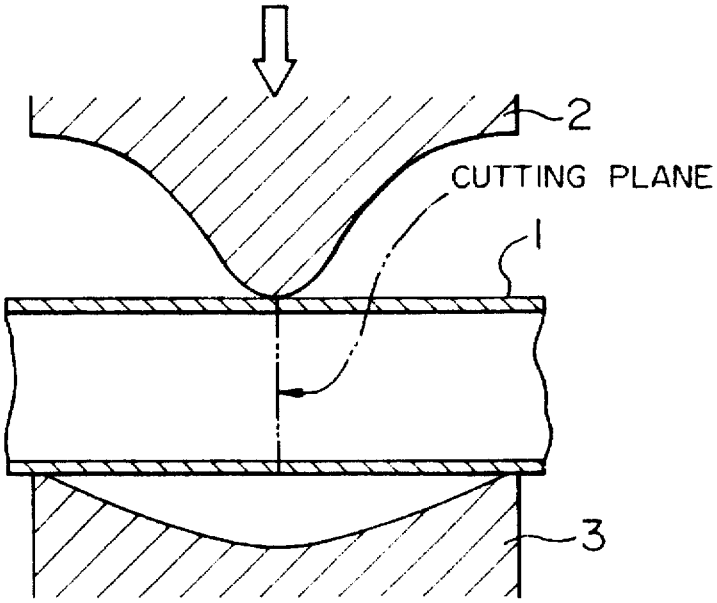
FIG. 5 is a sectional view which explains the relationship between a cylindrical raw pipe and forming dies.
Figure 6:
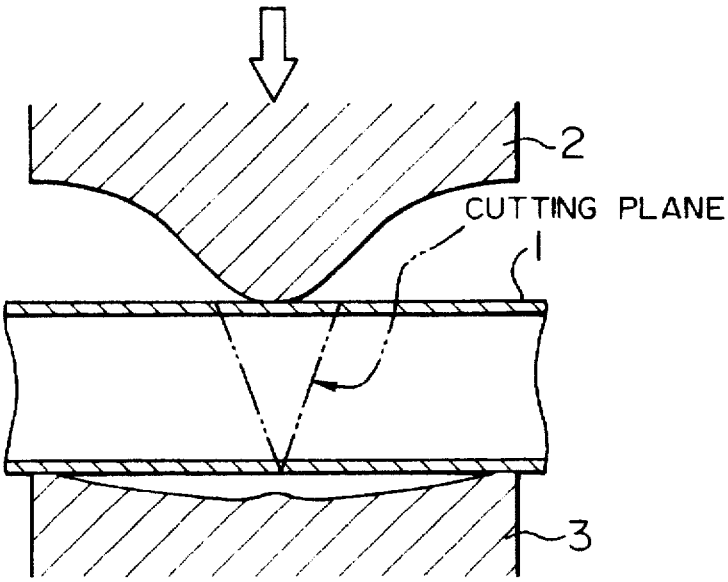
FIG. 6 is a sectional view which explains the relationship between a cylindrical raw pipe and forming dies.
Figure 7:
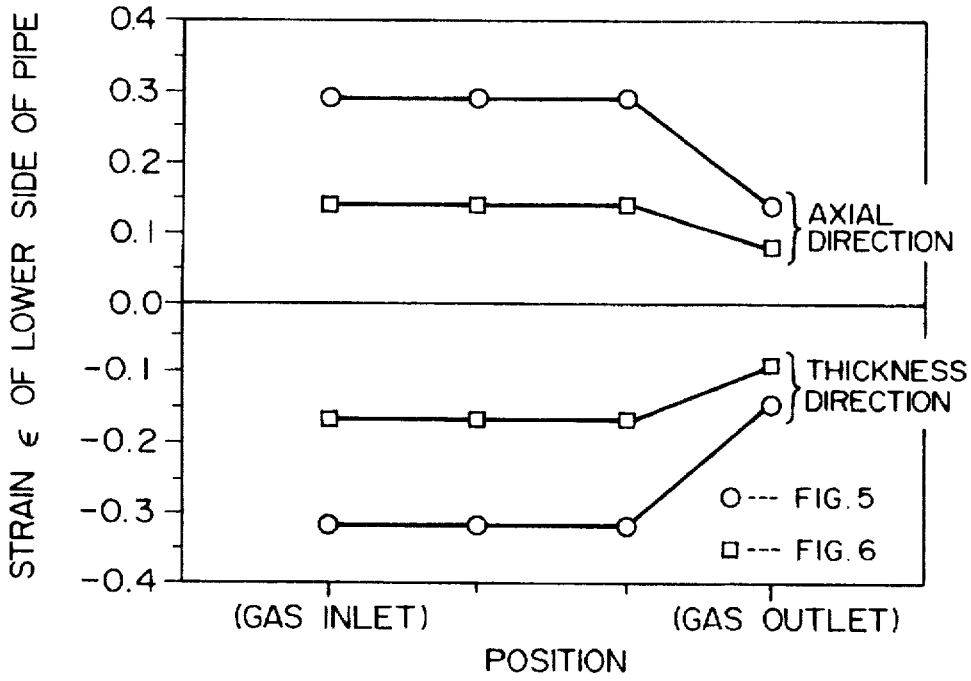
FIG. 7 is a diagram which shows distribution of strains appearing at several sections of the non-circular pipe formed in accordance with the first embodiment of the present invention.

In this embodiment, forming is achieved, as shown in FIG. 4, such that two non-circular pipes 14a, 14b are connected to each other in the longitudinal direction. When forming is performed by means of the dies 2 and 3 shown in FIG. 5 to obtain the configuration shown in FIG. 4 where the rectangular shape on the outflow side of the final formed product shown in FIG. 3 is smoothly connected to the rectangular shape of the other final product, a quantity of deformation on the lower surface side of the raw pipe becomes large during a forming process as shown by ○ marks in FIG. 7 and a large axial tensile stress appears, causing a thickness of the formed product to be extremely reduced (the compression strain in the direction of a thickness is enlarged). For this reason, in this embodiment, as shown in FIG. 6, used is a die assembly which assures that a formed product is obtained in a configuration in which two non-circular pipes are connected to each other so that the lower surface sides thereof become substantially flat. By using the die assembly having such structure, it is possible to reduce a quantity of deformation on the lower surface side of the raw pipe in which a large thickness reduction occurs. Therefore, the axial tensile strain of the non-circular section pipe during the forming process is remarkably reduced as shown by □ marks in FIG. 7.

According to this embodiment, it is possible to form two non-circular pipes which are integrally connected to each other and to remarkably reduce the wall thickness reduction of the formed product; therefore, a non-circular pipe can be effectively formed with excellent accuracy of the wall thickness dimensions.

Figure 9:
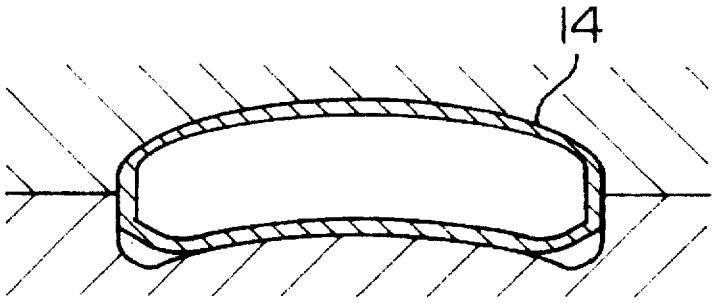
FIG. 9 is an explanatory view which shows the state that a rectangular section of the non-circular pipe is formed.
Figure 10:
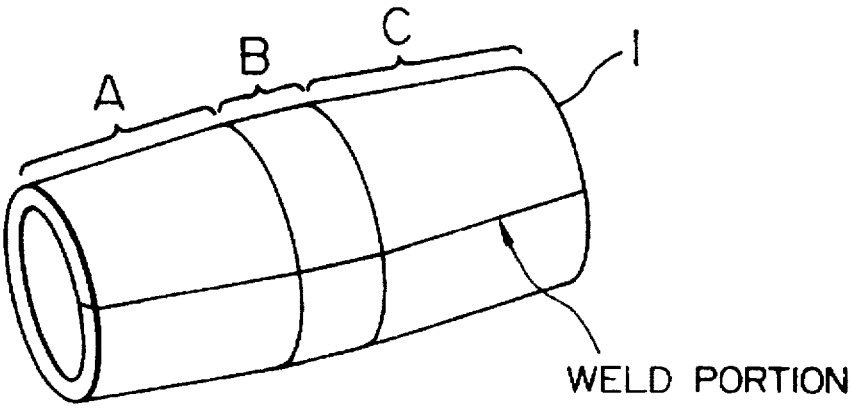
FIG. 10 is a perspective view of a cylindrical raw pipe of which central portion is expanded in accordance with the second embodiment of the present invention.

Next, a second embodiment of the present invention will be described below with reference to FIG. 8 to FIG. 10.

Figure 8:
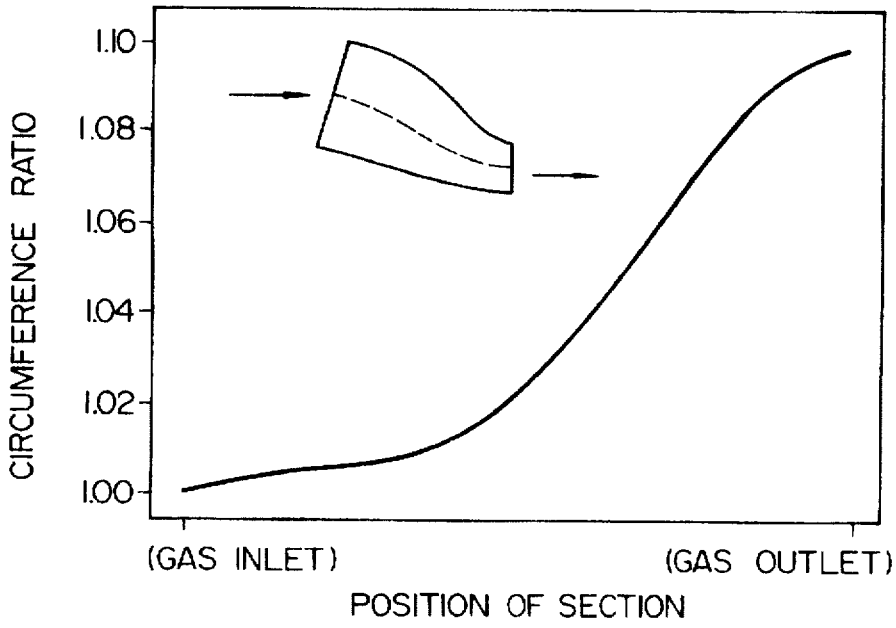
FIG. 8 is a diagram which shows variation of a circumference appearing at respective sections of a non-circular pipe formed in accordance with a second embodiment of the present invention.

The non-circular pipe shown in FIG. 3 is configured such that the circumference of the section at a respective position between the circular sectional shape on the inflow side and the rectangular sectional shape on the outflow side continuously varies as shown in FIG. 8 and the direction of flowing of gas on the inflow side is deviated from the direction of flowing of the gas on the outflow side and the circumference of section is increased toward the outflow side. In this case, when a straight pipe having a constant diameter is used as a starting material, there arises an occasion that the rectangular sectional shape on the outflow side can not be formed to a predetermined dimension as shown in FIG. 9 for the reasons that (1) the circumference on the outflow side is larger than that on the inflow side and (2) elongation of the lower surface side of the non-circular pipe is large when a cylindrical raw pipe is formed in the curved state by the upper and lower dies.

To form the non-circular pipe to a rectangular sectional shape in conformity with the shape of the dies by increasing internal pressure from the foregoing state, very high pressure is required. For example, to form a non-circular pipe of stainless steel of which each corner of the rectangular sectional shape has an inner radius about four times of a wall thickness, pressure of about 300 Mpa is required.

In view of the foregoing fact, in this embodiment, uses a raw pipe of which the circumference at any section is substantially the same as one at a corresponding section of the non-circular pipe as shown in FIG. 8. More specifically, at the same section of the raw pipe and the formed non-circular pipe, the circumference of the raw pipe equals a sum of the circumference of the formed non-circular pipe and a contracted length in the circumferential direction corresponding to Poisson's ratio. FIG. 10 is a perspective view of the raw pipe. The raw pipe is expanded around a center portion thereof since also in this embodiment, similar to the first embodiment, two non-circular pipes are simultaneously formed in the form of one pipe in which two non-circular pipes are connected with each other at outflow sides having long circumference. As shown in FIG. 10, the raw pipe comprises three pipe segments A, B and C which are connected to each other. The pipe segments A and C are a tapered cylindrical pipe and the pipe segment B is a straight cylindrical pipe. When a non-circular pipe is formed by using the raw pipe having a larger central portion by using the same method as in the first embodiment, it is possible to form the non-circular pipe without elongating the circumference of section. Thus, a rectangular section in conformity with the contour of the die assembly can be formed with very small pressure compared with the case in which a straight pipe is used as a raw pipe.

In this embodiment, description has been made with respect to a raw pipe comprising three cylindrical pipe segments connected to each other as a raw pipe. Alternatively, a raw pipe may be used having a central portion expanded which is produced by roll-forming a plate material into a tapered pipe and then welding the opposite ends of two roll-formed tapered pipes. Otherwise, the circumference of a cylindrical pipe may be partially enlarged or contracted without performing welding. In this case, a spinning process, a bulging process or a drawing process may be used. In the case of the spinning process, a straight pipe is used and the central portion thereof is expanded or the opposite end portions are drawn. In the case of the bulging process, a die having a predetermined contour is arranged on the outside of a cylindrical pipe and pressure is applied in the pipe in order to allow the central portion of the cylindrical pipe to be expanded. In the case of the drawing process, a straight pipe is used and the opposite end portions of the straight pipe are drawn by using a die or the like in order to allow an outer diameter of the central portion to be larger than that of the opposite end portions. Which process is used is determined on the basis of the contour of a non-circular pipe to be formed. When the raw pipe formed by using one of the processes is subjected to strain-relief heat treatment after completion of the forming, subsequent forming can be easily performed, and an occurrence of strain after further can be reduced.

In the first and second embodiments, each section is deformed while the raw pipe is being bent, and thereafter a predetermined pressure is applied in the raw pipe. However, provided that a non-circular pipe does not need dimensional accuracy, the applying pressure may be omitted.

Next, a third embodiment of the present invention will be explained below with reference to FIG. 11 and FIG. 12.

In this embodiment, also a raw pipe used in the second embodiment is produced by a forming apparatus. The raw pipe having a central part expanded as shown in FIG. 10 can be formed by an apparatus shown in FIG. 11 and FIG. 12 in which an apparatus for working the raw pipe is incorporated shown in FIG. 1. In FIG. 12, reference numerals 15*a* and 15*b* denote split dies for expanding the central portion of a cylindrical raw pipe, and reference numerals 16*a* and 16*b* denote hydraulic cylinders for displacing the split dies.

A central portion of the cylindrical raw pipe is expanded by using the foregoing apparatus. First, as shown in FIG. 11, while an upper die 2 and lower dies 3*a* and 3*b* are kept opened in the upward/downward direction, a cylindrical raw pipe 1 is placed on lower holders 4*b*. Subsequently, upper holders 4*a* are lowered by the holder restricting hydraulic cylinders 6 to firmly hold the cylindrical raw pipe 1. Next, the split dies 15*a* and 15*b* are forwardly displaced from the radial direction of the cylindrical pipe by actuating the hydraulic cylinders 16*a* and 16*b* so that the slit dies 15*a* and 15*b* are integrated with each other in such a manner as to cover the cylindrical pipe. The foregoing state is maintained, and the seal cylinders 5*a* and 5*b* are displaced in the forward direction by the hydraulic cylinders 7*a* and 7*b* to flare-work the opposite ends of the cylindrical raw pipe. The flare-working for the opposite ends of the cylindrical raw pipe is achieved by tapering a part of each of the seal cylinders 5*a* and 5*b* adapted to come into contact with the cylinder raw pipe as well as a part of each of the upper holders 4*a* and the lower holders 4*b* corresponding to the seal cylinders 5*a* and 5*b*. At this time, the inside of the cylindrical raw pipe is sealed by reliably squeezing the seal members 9 in the flare portions of the cylindrical raw pipe.

Figure 11:
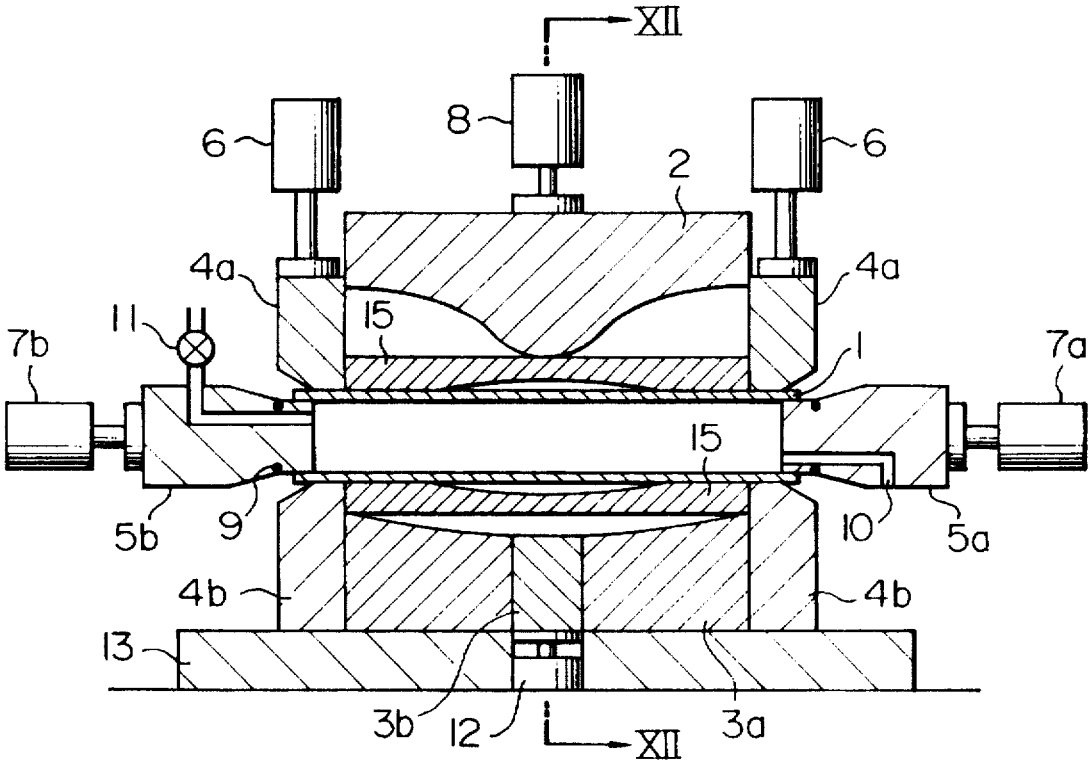
FIG. 11 is a sectional view of a forming apparatus for forming a non-circular pipe in accordance with a third embodiment of the present invention.
Figure 12:
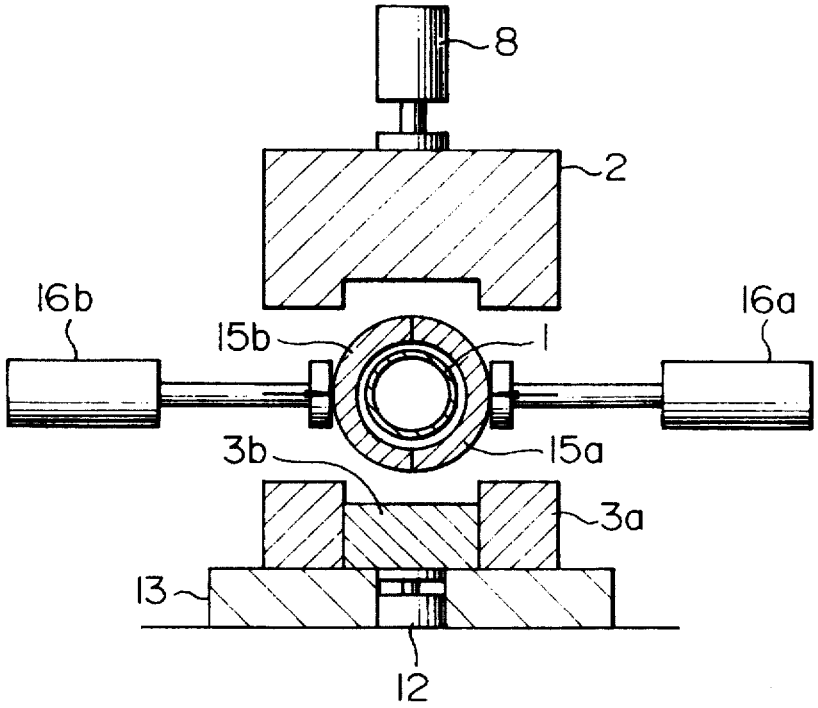
FIG. 12 is a sectional view of the forming apparatus taken along line XII—XII in FIG. 11.

This state is a state as shown in FIG. 11 and FIG. 12. Next, liquid serving as a pressure medium is supplied through the hydraulic pressure introducing hole 10 formed on the seal cylinder 5*a* by the pump (not shown) so that air in the cylindrical raw pipe is expelled and the cylindrical raw pipe is filled with the liquid. When the cylindrical raw pipe is filled with the liquid, the air vent valve 11 disposed on the seal cylinder 5*b* is closed. In addition, the liquid is further supplied by the pump (not shown) so that the cylindrical raw pipe is loaded with a predetermined pressure. Thus, the cylindrical raw pipe is expanded to a predetermined contour. When the expansion is completed, the dies 15*a* and 15*b* are displaced in the rearward direction by the cylinders 16*a* and 16*b*. Thereafter, the cylindrical raw pipe 1 is formed to a non-circular pipe by using the same method as that in the first embodiment.

Figure 14:
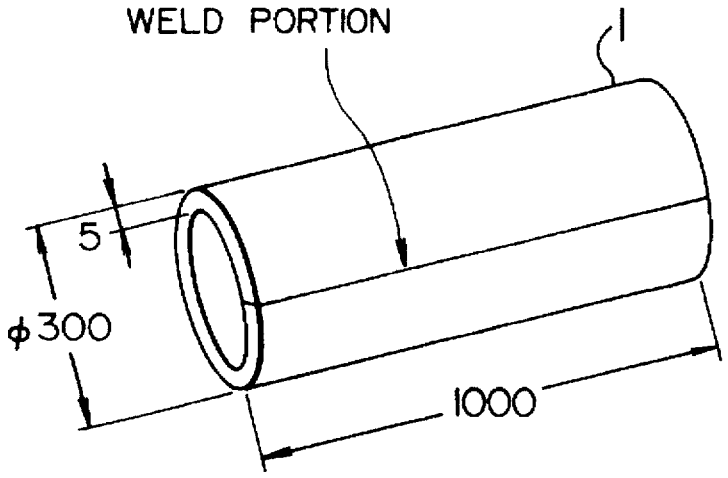
FIG. 14 is a perspective view of a cylindrical raw pipe to be used for forming the non-circular pipe shown in FIG. 13.
Figure 15:
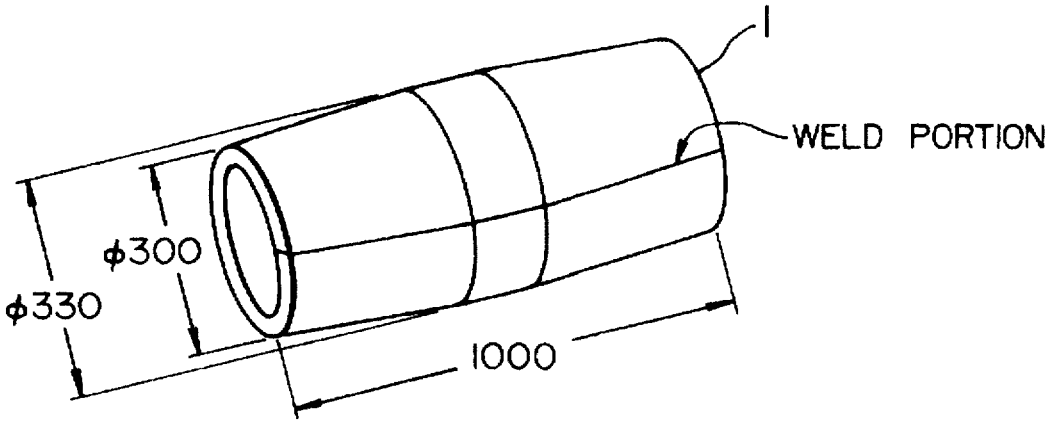
FIG. 15 is a perspective view of the cylindrical raw pipe of which central portion is expanded.

A concrete example of the foregoing embodiment will be described below with reference to FIG. 13 to FIG. 15.

Figure 13:
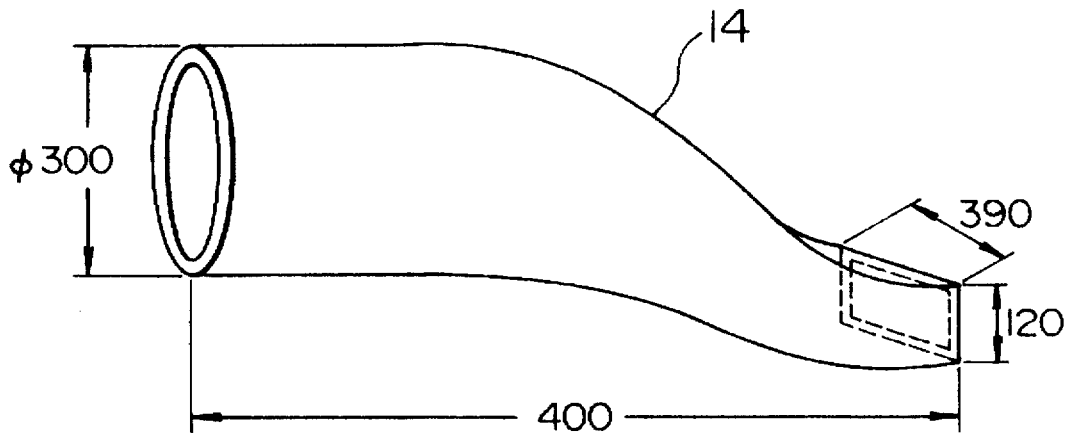
FIG. 13 is a perspective view of a non-circular pipe, i.e., a gas turbine part formed in accordance with the third embodiment of the present invention.

A non-circular pipe shown in FIG. 13 is a turbine part, and since a sectional shape varies in the longitudinal direction, and moreover, it is bent, it is called a non-circular bent pipe. It is a part serving as a flow passage for conducting high temperature gas burnt in a combustion chamber, i.e., a main component of a gas turbine, to a turbine blade. The gas inflow side of the bent pipe exhibits a circular section and the outflow side of the same exhibits a rectangular section, and sectional shape of the intermediate part therebetween continuously varies.

Figure 16:
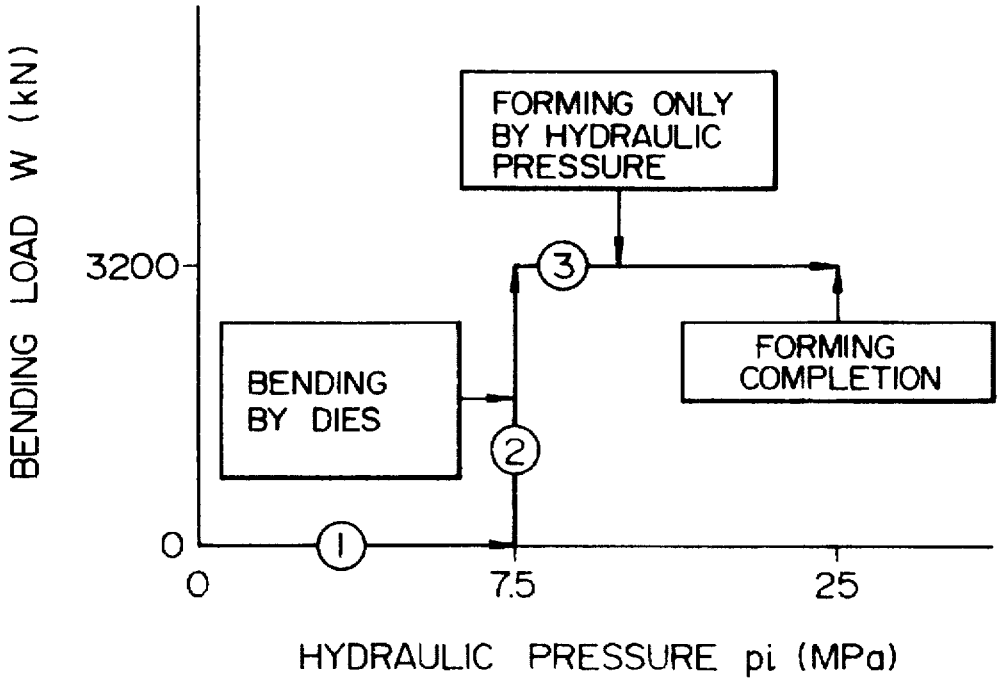
FIG. 16 is an explanatory view which explains a process for forming the non-circular section pipe in accordance with the third embodiment of the present invention.

The shape and dimensions of the bent pipe is as shown in FIG. 13, the gas inflow side exhibits a circular section having an outer diameter of 300 mm, the gas outflow side exhibits a rectangular section having a height of 120 mm and a length of 400 mm, and a sectional shape of the intermediate part therebetween continuously varies from a circular shape to a rectangular shape. A circumference of the bent pipe becomes larger from the inflow side of gas toward the outflow side of the same, and the circumference of the rectangular section on the gas outflow side is dimensioned to be about 1.1 times the circumference of the circular section on the gas inflow side. This bent pipe is formed in the apparatus shown in FIG. 11 and FIG. 12 with a straight stainless steel pipe having an outer diameter of 300 mm and a wall thickness of 5 mm as a cylindrical raw pipe. Prior to the forming, pressure of about 20 MPa is applied in the straight pipe shown in FIG. 14 in order to the circumference of each section of the straight pipe to be substantially equal to the circumference of the section of the bent pipe, causing the central portion to be expanded as shown in FIG. 15. Thereafter, the non-circular bent pipe is formed by using a process which will be explained with reference to FIG. 16. First, to prevent the cylindrical raw pipe from being buckled during a press bending forming process, about 7.5 MPa is applied to the cylindrical raw pipe (1). While the foregoing state is maintained, the upper die 2 is lowered in order to impart bending load W of about 3,200 kN to the cylindrical raw pipe 1 so that respective section is formed to a non-circular shape while bending the cylindrical raw pipe 1 (2). Subsequently, the pressure in the raw pipe is increased to about 25 MPa in order to allow the raw pipe to be formed in conformity with the shape of the upper and lower dies 2 and 3, whereby the forming operation is completed (3). Next, a formed product is taken out of the apparatus by using the method in the aforementioned embodiment. In this embodiment, the rectangular portion on the outflow side has corners each having an inner radius of 20 mm, resulting in the shape of the corner being formed as designed. A part after completion is cut at the central portion which serves as the outflow part, and additional work is imparted to the cut surface to provide two non-circular bent pipes.

Figure 17:
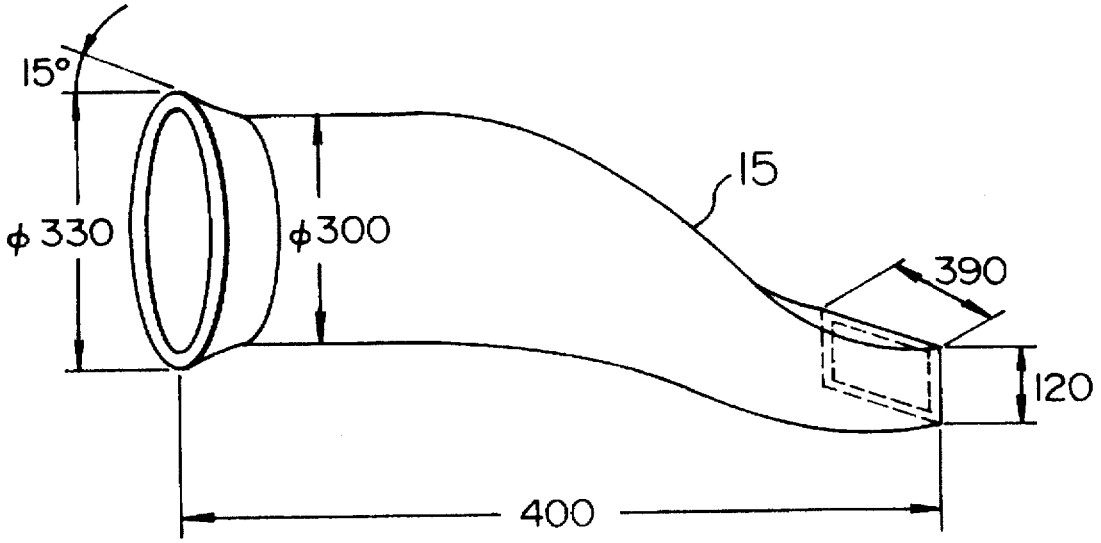
FIG. 17 is a perspective view of a turbine part having irregular sections formed in accordance with another embodiment of the present invention.

In the aforementioned embodiments, the end portions of the cylindrical raw pipe are subjected to flare-working for the purpose of sealing the pressure applied in the cylindrical raw pipe. A gas turbine part having a gas inflow side flare-worked at 15° as shown in FIG. 17 for the purpose of improving gas flow passage properties is sometimes used. In this case, by forming a taper worked portion for sealing the pressure in the raw pipe in coincidence with a flared portion of the gas turbine part, the taper worked portion can be utilized as a part of the gas turbine part as it is.

According to this embodiment, a cylindrical raw pipe having a different circumference along the longitudinal direction of the pipe used in the second embodiment can be worked in the forming apparatus for a non-circular pipe, and forming can continuously be achieved from a cylindrical raw pipe to a final formed shape. Thus, an accuracy of each product can be stabilized.

The steps (2) and (3) in this embodiment are effective for forming a corner radius of the rectangular section, and moreover, reducing spring-back of a formed product, resulting in the dimensional accuracy of the formed product being improved.

Since the non-circular bent pipe formed by using the aforementioned method has substantially the same circumference in respective sections before and after the forming operation, the pipe is not elongated in the longitudinal direction during the forming step, and a wall thickness after completion of the forming operation is substantially the same in respective sections. Thus, local thermal stress does not arise during practical use, and reliability of the non-circular bent pipe is remarkably improved. In addition, there is no need to design by taking a local thin wall portion as a reference when the non-circular bent pipe is designed in consideration of reduction of a wall thickness due to high temperature oxidation, and therefore remarkable reduction of a weight of the non-circular bent pipe can be expected in contrast with a conventional non-circular bent pipe having large difference in thickness in respective sections.

In each of the aforementioned embodiments, when a cylindrical raw pipe is subjected to heat treatment after working thereof, strain induced by working of the cylindrical raw pipe can be eliminated.

In this embodiment, when solution heat treatment, stress relief annealing or similar heat treatment is performed after completion of the final forming operation, strain induced by working or fining of structure can be eliminated, whereby reliability under practical environment of a gas turbine can be remarkably improved.

According to the present invention, tensile strain in the circumferential direction and the axial direction at respective sections can be remarkably reduced during the forming step of a non-circular pipe. Thus, the non-circular pipe can be formed at a high accuracy.

Since the pressure required for the forming can be reduced, the forming apparatus is constructed and provided with smaller dimensions at an inexpensive cost.

Since a non-circular pipe can be formed at a high accuracy, it can be used as a flow passage member for a gas turbine, and reliability of the gas turbine can be remarkably improved.

What is claimed is:

1. A method for forming non-circular pipes having different sectional shapes along a longitudinal direction thereof, comprising:

providing a raw pipe between upper and lower dies;

sealing ends of the raw pipe;

applying an internal pressure within the sealed pipe;

while maintaining at least said internal pressure, actuating at least one of said upper and lower dies to apply a load to said raw pipe in a direction perpendicular to said longitudinal direction to form an intermediate pipe having an intermediate section with a non-circular cross-section, wherein said intermediate section has a lower surface which is substantially flat; and then removing a portion of said intermediate pipe at said intermediate section to form two non-circular pipes.

2. A gas turbine part comprising a non-circular pipe formed by a method according to claim 1, wherein one end surface of said non-circular pipe exhibits a circular shape, the other end surface exhibits a substantially rectangular shape, and respective sections between the one end surface and the other end surface continuously changes from the circular shape to the substantially rectangular shape.

3. A gas turbine in which said gas turbine part according to claim 2 is used as a passage for conducting the gas burnt in a combustion chamber to a turbine.

4. A method according to claim 1, wherein the raw pipe has a circular cross-section.

5. A method according to claim 1, comprising a further step of providing said raw pipe with a circular cross-section along its entire length with a central section having a larger diameter than end sections.

6. A method according to claim 5, wherein said central section is provided with the larger diameter by applying an internal pressure to said raw pipe and expanding said central section to a predetermined contour.

7. A method according to claim 1, further comprising heat treating the intermediate pipe.

8. A method according to claim 1, wherein no axial tensile force is applied to said raw pipe during forming, whereby tensile strain in the axial direction is reduced.

* * * * *